US008692636B2

(12) United States Patent
Reuber

(10) Patent No.: US 8,692,636 B2
(45) Date of Patent: Apr. 8, 2014

(54) BISTABLE MAGNETIC ACTUATOR FOR A MEDIUM VOLTAGE CIRCUIT BREAKER

(75) Inventor: Christian Reuber, Willich (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/448,080

(22) Filed: Apr. 16, 2012

(65) Prior Publication Data

US 2012/0286905 A1 Nov. 15, 2012

Related U.S. Application Data

(63) Continuation of application No. PCT/EP2010/006287, filed on Oct. 14, 2010.

(30) Foreign Application Priority Data

Oct. 14, 2009 (EP) ..... 09012966

(51) Int. Cl.
*H01F 7/00* (2006.01)

(52) U.S. Cl.
USPC ..... 335/230; 335/220

(58) Field of Classification Search
USPC ..... 335/151, 153, 154, 219, 220, 229, 230, 335/234, 237, 279–284; 310/12.01, 12.02, 310/14, 15, 17, 23–24, 30, 34
See application file for complete search history.

(56) References Cited

U.S. PATENT DOCUMENTS

| | | | | |
|---|---|---|---|---|
| 5,912,604 | A * | 6/1999 | Harvey et al. | 335/9 |
| 6,130,594 | A | 10/2000 | Morant et al. | |
| 6,950,000 | B1 * | 9/2005 | Lanni et al. | 335/229 |
| 7,843,293 | B1 | 11/2010 | Bonjean et al. | |
| 2009/0039989 | A1 | 2/2009 | Reuber | |
| 2012/0119594 | A1 * | 5/2012 | Gosvener | 310/20 |

FOREIGN PATENT DOCUMENTS

| | | | |
|---|---|---|---|
| DE | 199 10 326 | A1 | 9/2000 |
| EP | 0 898 780 | B1 | 4/2000 |
| EP | 1 843 375 | A1 | 10/2007 |
| GB | 2 380 065 | A | 3/2003 |
| NL | 6917252 | A | 5/1971 |
| WO | WO 03030188 | A1 * | 4/2003 ..... H01F 7/16 |

OTHER PUBLICATIONS

International Search Report (PCT/ISA/210) issued on Nov. 16, 2010, by European Patent Office as the International Searching Authority for International Application No. PCT/EP2010/006287.
Written Opinion (PCT/ISA/237) issued on Nov. 16, 2010, by European Patent Office as the International Searching Authority for International Application No. PCT/EP2010/006287.

* cited by examiner

*Primary Examiner* — Bernard Rojas
(74) *Attorney, Agent, or Firm* — Buchanan Ingersoll & Rooney PC

(57) ABSTRACT

Exemplary embodiments are directed to a bistable magnetic actuator for a medium voltage circuit breaker arrangement, including at least one electrical coil for switching a ferromagnetic armature between a first limit position and a second limit position effected by an electromagnetic field, at least one permanent magnet for holding the armature in one of the two limit positions corresponding to an open and a closed electrical switching position respectively of the mechanically connected circuit breaker. The armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement.

18 Claims, 3 Drawing Sheets

BISTABLE MAGNETIC ACTUATOR FOR A MEDIUM VOLTAGE CIRCUIT BREAKER

RELATED APPLICATION(S)

This application is a continuation under 35 U.S.C. §120 of International Application PCT/EP2010/006287 filed on Oct. 14, 2010 designating the U.S., which claims priority to European Application EP 09012966.9 filed in Europe on Oct. 14, 2009, the contents of which are hereby incorporated by reference in their entireties.

FIELD

The disclosure relates to a bistable magnetic actuator for a medium voltage circuit breaker actuating, such as having at least one electrical coil for switching a ferromagnetic armature between a first limit position and a second limit position effected by an electromagnetic field

BACKGROUND INFORMATION

It is a matter of common knowledge to use a magnetic actuator with high force density to operate moving contacts for a purpose of electrical power interruption in the medium-voltage field of technology. Known magnetic actuators have a design with a fixed core in the center of the device, and two moveable plungers, one above and one below the core, that are connected with a plunger rod. Such a device is supposed to generate a high static holding force in the closed position to latch opening and contact springs. The magnitude of this static holding force is the key parameter for the design of the entire circuit breakers and for space and weights reasons it is generally advantageous to generate this force with a small magnetic actuator. In the open position, a lower static holding force is needed to keep the circuit breaker in open position. For bringing the actuator from close to open position feeding the electrical coil of the actuator with electrical energy is needed.

The document EP 0 898 780 B1 describes a magnetic actuator with a ferromagnetic armature which is displaceable linearly between two limit positions and which is mechanically connected to a circuit breaker and which in the limit positions is under the influence of magnetically generated forces. The armature and the ferromagnetic shunt body are arranged in succession in a space between first and second abutment. The abutments are pole surfaces of magnetic circuits which include at least one permanent magnet for generating a holding force for the armature. This known device is as well supposed to operate a vacuum circuit breaker. In the closed position, the ferromagnetic shunt body is apart from the armature. The shunt can now be moved towards the armature to initiate the opening operation of the circuit breaker. The known solution is based on a design that does not use the full potential of the static holding force as the effective area between the moveable armature and the fixed yoke is limited to the area that is inside the coil. As a result, the actuator is almost twice as big as needed.

WO 03/030188 A1 discloses a further magnetic actuator, such as for a vacuum circuit breaker design being large in size. Two electrical coils are needed in order to operate the magnetic actuator or bringing a connected circuit breaker from an open to a closed switching position. A first magnetic flux is generated by the armature and the yoke in such a way that the armature is held in one limit position and the electrical coil generates a second magnetic flux that actuates the armature. The permanent magnet is located between the yoke and a fixed magnetic return element, in such a way that the magnetic flux runs via the magnetic return element. In addition, the armature outside the yoke covers a front face of the yoke, said face running perpendiculary to the direction of displacement of the armature. Since the permanent magnet is provided to hold the magnetic armature in one of the two limit positions, neither mechanically latching nor a constant electrical current supply is specified.

Also this known solution uses the armature for generating the static holding force in both limit positions. This solution implies a second magnetic path from the magnets to the armature that is only effective in the open limit position. This second magnetic path increases sizes again and weights of the magnetic actuator. The known solution also specifies a closed room around both the armature. The ferromagnetic shunt body forms the two abutments that need to fulfill magnetic functions. This increases the size and weight of the actuator further. The known solution entails the driving of the ferromagnetic shunt body back to the lower abutment during the opening operation. This driving should include additional energy that is not available for the opening operation, which is the most critical operation of a circuit breaker in case of short circuit switching.

SUMMARY

An exemplary bistable magnetic actuator for a medium voltage circuit breaker arrangement is disclosed. The actuator, comprising: at least one electrical coil for switching a ferromagnetic armature between a first limit position and a second limit position effected by an electromagnetic field; at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger unlockable attached on the opposite side of the plunger rod in an axial distance from the core element and movable on the core element to shift the armature to the second limit position by reducing the magnetic flux in the upper plunger.

An exemplary medium voltage circuit breaker is disclosed comprising: at least one vacuum interrupter, wherein each interrupter includes: moving electrical contacts for electrical power interruption, operating via a common jackshaft for mechanically coupling the moving electrical contacts with a bistable magnetic actuator, wherein the bistable actuator includes: at least one electrical coil for switching a ferromagnetic armature between a first limit position and a second limit position effected by an electromagnetic field; at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger unlockable attached on the opposite side of the plunger rod in an axial distance from the core element and movable on the core element to shift the armature to the second limit position by reducing the magnetic flux in the upper plunger.

An exemplary vacuum interrupter is disclosed, comprising: moving electrical contacts for electrical power interruption, operating via a common jackshaft for mechanically coupling the moving electrical contacts with a bistable magnetic actuator, wherein the bistable actuator includes: at least one electrical coil for switching a ferromagnetic armature between a first limit position and a second limit position effected by an electromagnetic field; at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger unlockable attached on the opposite side of the plunger rod in an axial distance from the core element and movable on the core element to shift the armature to the second limit position by reducing the magnetic flux in the upper plunger.

BRIEF DESCRIPTION OF THE DRAWING

FIG. 1 is a schematic view of the medium-voltage circuit breaker operated by a magnetic actuator in accordance with an exemplary embodiment view of the magnetic actuator in the closed position in accordance with an exemplary embodiment;

DETAILED DESCRIPTION

Figure 1:
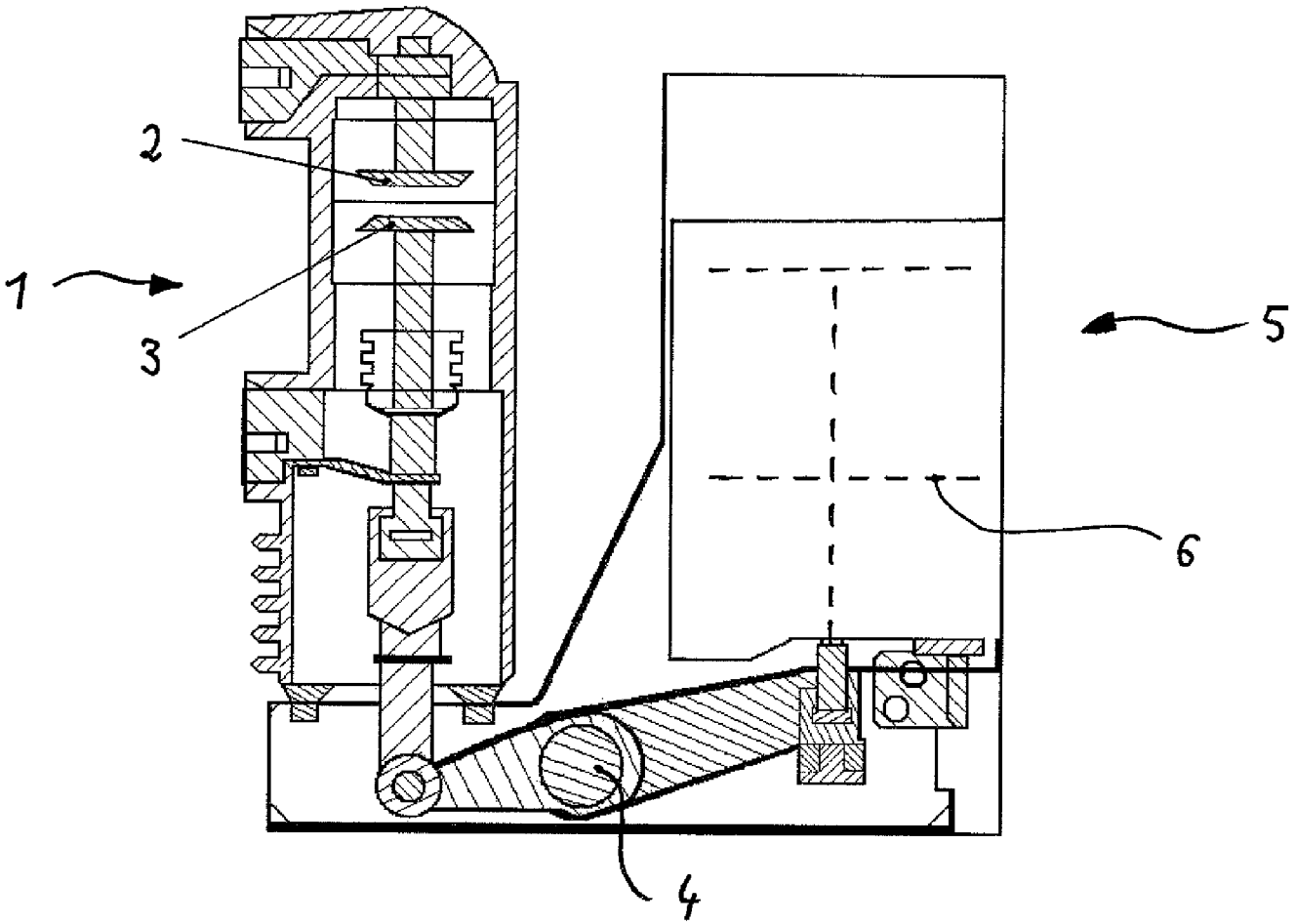
FIG. 1 is a schematic view of the medium-voltage circuit breaker operated by a magnetic actuator in accordance with an exemplary embodiment.

Exemplary embodiments of the present disclosure provide a bistable magnetic actuator for a medium voltage circuit breaker which has small dimensions and which allows a low-energy opening operation.

A medium-voltage circuit breaker rated between 1 and 72 kV, for example, can be assembled into a metal-enclosed switch gear line ups for indoor use, or may be installed outdoor in a substation. Nowadays, vacuum circuit breakers replaced air-break circuit breakers for indoor applications. The characteristics of medium-voltage breakers are given by international standards, such as vacuum circuit breakers rated current up to 300 Ampere, for example. These breakers interrupt the current by creating and extinguishing the arc in vacuum container. These are generally applied for voltages up to about 35,000 V, which corresponds roughly to the medium-voltage range of power systems. Vacuum circuit breakers tend to have longer life expectancies than air circuit breakers.

Nevertheless, the present disclosure is not only applicable to vacuum circuit breakers, but also to air circuit breakers or modern SF6 circuit breakers having a chamber filled with sulfur hexafluoride gas.

According to an exemplary embodiment of the disclosure a bistable magnetic actuator for a medium voltage circuit breaker is provided including at least one electrical coil for switching a ferromagnetic armature between a first limit position and a second limit position effected by an electromagnetic field, at least one permanent magnet for holding the armature in one of the two limit positions corresponding to an open or a closed electrical switching position of the mechanically connected circuit breaker, wherein the armature includes an upper plunger resting on a ferromagnetic coil element of the one electrical coil for static holding the armature in the first limit position which is attached to a plunger rod extending through the ferromagnetic core element and through the permanent magnet for mechanically coupling the actuator to the circuit breaker, wherein the armature also includes a lower plunger unlockable attached on the opposite side of the plunger rod in an axial distance from the core element and moveable on the core element in order to shift the armature to the second limit position by reducing the magnetic flux in the upper plunger.

Exemplary embodiments disclosure herein are based on the effect that the fraction of the flux of the at least one permanent magnet will be drained into the lower plunger. The force that is generated by the remaining flux at the transitions from the core element to the upper plunger is no longer sufficient to latch the drive against the opening force of the circuit breaker mechanism, which originates from the one or more contact springs and the one or more opening springs therein. Theses springs are sufficient to press the circuit breaker and the actuator in the open position.

Exemplary embodiments of the present disclosure describes how the actuator can be brought from close to open position without feeding the coil of the actuator. Therefore, a design of an actuator can be specified, having less material than prior art design while achieving the same performance, and resulting in a smaller and lighter solution. The full potential of the static holding force can be used, as the effective area between the moveable plunger and the fixed core element is both the area inside the electrical coil and the area of the two legs outside the electrical coil. Dedicated plungers are used for generating the static holding force in the closed and open position. Plungers can lay on top or at the bottom of the core element to provide compact design. A closed room around all parts of this device should not be implemented for magnetic reasons. A simple plastic cover can protect the magnetic air gap from intrusion of external particles. The lower plunger can slide freely on the plunger rod during the opening operation and no force is drained from the system for moving the lower plunger and the full force is available to the opening operation of the circuit breaker. The lower plunger is moved away from the permanent magnet, for example, back to the position that is normal for a closed circuit breaker, during the normal closing operation of the magnetic actuator.

An exemplary armature of the present disclosure can include a ferromagnetic yoke surrounding the electrical coil and the permanent magnet in order to create a magnetic circuit including the upper plunger and the lower plunger.

In an exemplary embodiment a small spring or simply gravity (if the actuator is assembled upside-down inside a circuit breaker), can initiate the opening operation of the actuator after unlocking it from the plunger rod before.

In a exemplary embodiment of the present disclosure a stop element can be is attached to the plunger rod adjacent to the lower plunger to define the second limit position of the magnetic actuator.

According to another exemplary embodiment of the present disclosure an intermediate plate of non-magnetic material is arranged between the lower plunger and the core element for controlling the magnetic distance between both parts of the armature. This arrangement can be used to adjust the actuator's static force in its open position as desired. At the same time, the thickness of this intermediate plate can be used to adjust the magnitude of current of the electrical coil that is needed to initiate the closing operation, and therewith the amount of energy that is used for the closing operation.

According to another exemplary embodiment of the present disclosure fastening or releasing the lower plunger on the plunger rod can be achieved by fixing means mounted on the lower plunger. The fixing means can include two gripper elements that may be attached to the lower surface of the lower plunger and corresponding with a groove of the plunger rod for fastening the lower plunger thereon. The gripper elements can comprise (e.g., consist of) sheet metal mounted below the lower plunger with screws. Additionally, the fixing means can include a spring element for pressing the gripper elements against the groove of the plunger rod. The spring element serves to secure the form-fit mechanical connection.

In order to release the lever arm arrangement of the fixing means easily, a bowden cable can be operated by a low-energy electromagnetic actuator in accordance with an electrical control signal. As the lower plunger is no longer locked on the plunger rod, it now can be moved towards the core element to initiate the opening operation.

FIG. 1 is a schematic view of the medium-voltage circuit breaker operated by a magnetic actuator in accordance with an exemplary embodiment. The medium-voltage circuit breaker as shown in FIG. 1 includes (e.g., consists of) a vacuum interruptor 1 having an inner fixed electrical contact 2 and a corresponding moveable electrical contact 3. Both electrical contacts 2 and 3 form a switch for electrical power interruption. The moveable electrical contact 3 is moveable between the closed and the open position via a jack shaft 4. This jack shaft 4 internally couples the mechanical energy of a bistable magnetic actuator 5 to the moving electrical contact 3 of the vacuum interruptor 1. The magnetic actuator 5 includes (e.g., consists of) a bistable magnetic system in which switching of an armature 6 to the relative positions are affected by magnetic fields generated by an electromagnet and permanent magnet arrangement.

Figure 2C:
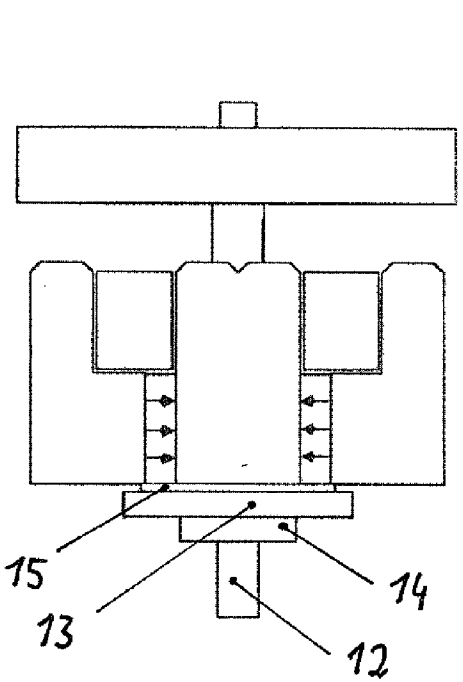
FIG. 2*c* is a detailed schematic view of the magnetic actuator in the open position in accordance with an exemplary embodiment.
Figure 2B:
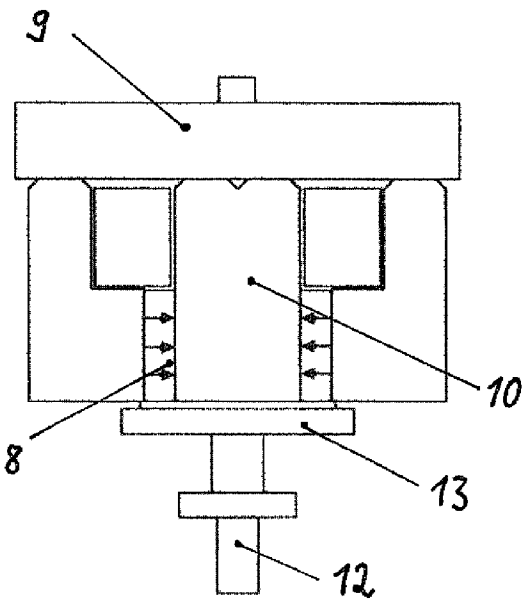
FIG. 2*b* is a detailed schematic view of the magnetic actuator in an intermediate position in accordance with an exemplary embodiment.
Figure 2A:
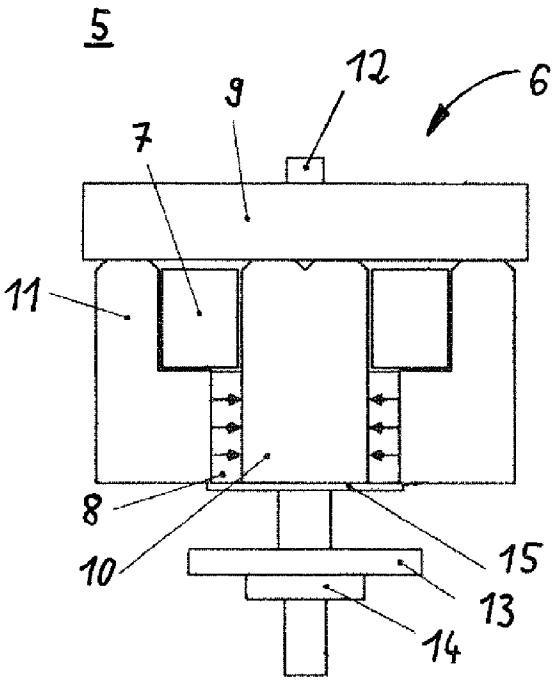
FIG. 2*a* is a detailed schematic

FIG. 2*a* is a detailed schematic FIG. 1 is a schematic view of the medium-voltage circuit breaker operated by a magnetic actuator in accordance with an exemplary embodiment view of the magnetic actuator in the closed position in accordance with an exemplary embodiment. According to FIG. 2*a* the magnet actuator 5 includes an electrical coil 7 to move the ferromagnetic armature 6 between two limit positions effected by a magnetic field. In the closed position (as shown) the magnetic actuator keeps the connected vacuum interruptor closed. Additionally, separate opening springs can be compressed by the static holding force of the magnetic actuator 5 that originates from the flux of a permanent magnet 8 which is arranged beside the electrical coil 7. No additional power or current in the electrical coil 7 is needed to maintain the closed position as shown.

The armature 5 further includes an upper plunger 9 resting on a ferromagnetic core element 10 of the one electrical coil 7 for static holding the armature 5 in the first limit position, i.e. the closed position. The upper plunger 9 is attached to a plunger rod 12. The plunger rod 12 is movable and extends axially through the ferromagnetic core element 10 for coupling the actuator 5 mechanically to the circuit breaker arrangement as described above.

Since the upper plunger 9 rests on the core element 10, the magnetic flux that is generated by the permanent magnet 8 is lead upwards through the core element 10 into the upper plunger 9. Here, at the transition from the core element 10 to the upper plunger 9, about half of the total static holding force is being generated. The flux splits up in the plunger 9 and flows back through a ferromagnetic yoke 11 surrounding the electrical coil 7 and the permanent magnet 8. At the transition from the upper plunger 9 to the yoke 11, the other half of the total static holding force is being generated.

A lower plunger 13 is located on the plunger rod 12 at a position that is far from the core element 10 so that it does not affect the magnetic circuit.

FIG. 2*b* is a detailed schematic view of the magnetic actuator in an intermediate position in accordance with an exemplary embodiment. FIG. 2*b* shows how the opening operation is initiated. The lower plunger 13 is released from the plunger rod 12 and forwarded to the core element 10 by the help of a—not shown—small spring element. As a result, a fraction of the flux of the permanent magnet 8 can be drained into the lower plunger 13. The force that is generated by the remaining flux of the transitions form the core element 10 to the upper plunger 9 is no longer sufficient to latch the drive against the opening force of the connected circuit breaker.

FIG. 2*c* is a detailed schematic view of the magnetic actuator in the open position in accordance with an exemplary embodiment. As a result of the movement shown in FIG. 2*b*, the plunger rod 12 moves into the open position as shown in FIG. 2*c*. A stop element 14 attached to the plunger rod 12 is provided in order to define the second limit position of the armature 6. An intermediate plate 15, made of non-magnetic material, is provided in order to control the magnetic distance of the lower plunger 13 to the core element 10. This can be used to adjust the actuator's static force in the open position to the needs of the application. After having completed the opening operation, as shown in FIG. 3, the lower plunger 13 can now be latched to the plunger rod 12.

Figure 3:
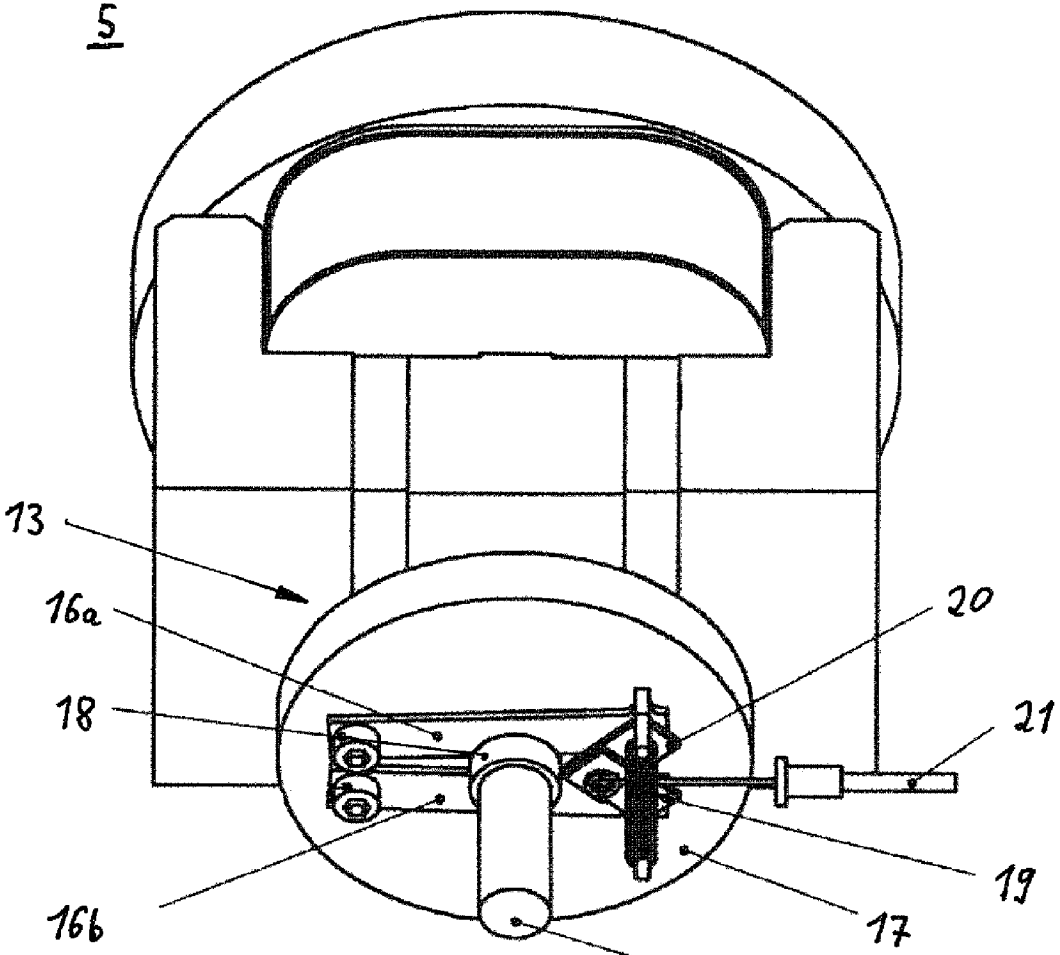
FIG. 3 is a perspective schematic view of the view of magnetic actuator's fixing means on the lower plunger in accordance with an exemplary embodiment.

FIG. 3 is a perspective schematic view of the view of magnetic actuator's fixing means on the lower plunger in accordance with an exemplary embodiment. As shown in FIG. 3 the lower plunger 13 includes fixing means for fastening or releasing it to the plunger rod 12. The fixing means includes two gripper elements 16*a*, 16*b* having (e.g., consisting of) sheet metal and pivotably attached to the lower surface 17 of the lower plunger 13. Both gripper elements 16*a*, 16*b* correspond with a groove 18 of the plunger rod 12 for fastening the lower plunger 13 thereon. If the actuator is not operating, a spring element 19 presses the gripper elements 16*a* and 16*b*, which slide against the groove 18 in the plunger rod 12, so that the lower plunger 13 is locked and cannot be moved along the plunger rod 12.

If the actuator is supposed to open, both gripper elements 16*a*, 16*b* can be pulled away from the plunger rod 12 using an actuatable lever arm arrangement 20. A bowden cable 21 can be provided for releasing the lever arm arrangement 20 by an electromagnet (not shown) or the like. As the lower plunger 13 is no longer locked on the plunger rod 12, it can now be moved towards the core element 10, as described above, to initiate the opening operation.

When the opening operation is accomplished and the bowden cable 21 is no longer being pulled, the spring element 19 can press gripper elements 16*a* and 16*b* on the plunger rod 12 to re-lock the lower plunger 13. Subsequently, a normal closing operation can be performed.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

Reference List

1 vacuum interrupter
2 electrical contact (fix)
3 electrical contact (moveable)
4 jack shaft
5 magnetic actuator
6 armature
7 electrical coil
8 permanent magnet
9 upper plunger
10 core element
11 yoke
12 plunger rod
13 lower plunger
14 stop element
15 intermediate plate
16 gripper element
17 lower surface
18 groove
19 spring element
20 lever arm arrangement
21 bowden cable

What is claimed is:

1. A bistable magnetic actuator for a medium voltage circuit breaker arrangement, comprising:

at least one electrical coil for switching a ferromagnetic armature between a first limit position and a second limit position effected by an electromagnetic field;

at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger releasably attached on the opposite side of the plunger rod in an axial distance from the core element via fixing means for fastening or releasing the lower plunger on the plunger rod and movable on the core element to shift the armature to the second limit position by reducing the magnetic flux in the upper plunger.

2. The bistable magnetic actuator according to claim 1, wherein the armature further comprises a ferromagnetic yoke surrounding the electrical coil and the permanent magnet in order to create a magnetic circuit including the upper plunger and the lower plunger.

3. The bistable magnetic actuator according to claim 1, wherein gravity force or additional spring force is provided for initial movement of the lower plunger to the core element after unlocking it from the plunger rod.

4. The bistable magnetic actuator according to claim 1, wherein the second limit position of the armature is defined by a stop element attached to the plunger rod adjacent to the lower plunger.

5. The bistable magnetic actuator according to claim 1, wherein an intermediate plate of non-magnetic material is arranged between the lower plunger and the core element for controlling the magnetic distance between both parts of the armature.

6. The bistable magnetic actuator according to claim 5, wherein the thickness of the intermediate plate is dimensioned based on a magnitude of the current in the electrical coil that is needed to initiate the shifting operation of the armature.

7. The bistable magnetic actuator according to claim 1, wherein the fixing means comprises two gripper elements pivotably attached to a lower surface of the lower plunger and corresponding with a groove in the plunger rod for fastening the lower plunger thereon.

8. The bistable magnetic actuator according to claim 1, wherein the fixing means comprises a spring element for pressing the gripper elements against the groove of the plunger rod.

9. The bistable magnetic actuator according to claim 1, wherein the fixing means comprises an actuatable lever arm arrangement for bridging the gripper elements in order to release the lower plunger from the plunger rod.

10. The bistable magnetic actuator according to claim 9, wherein a bowden cable is provided for releasing the lever arm arrangement by a low-energy operated electrical actuator in accordance with an electrical control signal.

11. A medium voltage circuit breaker comprising:

at least one vacuum interrupter, wherein each interrupter includes:

moving electrical contacts for electrical power interruption, operating via a common jackshaft for mechanically coupling the moving electrical contacts with a bistable magnetic actuator, wherein the bistable actuator includes:

at least one electrical coil for switching a ferromagnetic armature between a first limit position and a second limit position effected by an electromagnetic field;

at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger releasably attached on the opposite side of the plunger rod in an axial distance from the core element via fixing means for fastening or releasing the lower plunger on the plunger rod and movable on the core element to shift the armature to the second limit position by reducing the magnetic flux in the upper plunger.

12. The circuit breaker according to claim 11, wherein the armature further comprises a ferromagnetic yoke surrounding the electrical coil and the permanent magnet in order to create a magnetic circuit including the upper plunger and the lower plunger.

13. The circuit breaker according to claim 11, wherein gravity force or additional spring force is provided for initial movement of the lower plunger to the core element after unlocking it from the plunger rod.

14. The circuit breaker according to claim 1, wherein the second limit position of the armature is defined by a stop element attached to the plunger rod adjacent to the lower plunger.

15. The circuit breaker according to claim 11, wherein an intermediate plate of non-magnetic material is arranged between the lower plunger and the core element for controlling the magnetic distance between both parts of the armature.

16. The circuit breaker according to claim 15, wherein the thickness of the intermediate plate is dimensioned based on a magnitude of the current in the electrical coil that is needed to initiate the shifting operation of the armature.

17. The circuit breaker according to claim 11, wherein the fixing means comprises two gripper elements pivotably attached to a lower surface of the lower plunger and corresponding with a groove in the plunger rod for fastening the lower plunger thereon.

18. A vacuum interrupter, comprising:

moving electrical contacts for electrical power interruption, operating via a common jackshaft for mechanically coupling the moving electrical contacts with a bistable magnetic actuator, wherein the bistable actuator includes:

at least one electrical coil for switching a ferromagnetic armature between a first limit position and a second limit position effected by an electromagnetic field;

at least one permanent magnet for holding the armature in one of the two limit positions corresponding to an open and a closed electrical switching position respectively of the mechanically connected circuit breaker, wherein the armature includes an upper plunger resting on a ferromagnetic core element of the one electrical coil for static holding the armature in the first limit position, which is attached to a plunger rod extending through the ferromagnetic core element and through the permanent magnet for mechanically coupling the actuator to the circuit breaker arrangement, and wherein the armature includes a lower plunger releasably attached via fixing means for fastening or releasing the lower plunger on the plunger rod on the opposite side of the plunger rod in an axial distance from the core element and movable on the core element to shift the armature to the second limit position by reducing the magnetic flux in the upper plunger.

* * * * *